US011913209B2

(12) United States Patent
Tang et al.

(10) Patent No.: US 11,913,209 B2
(45) Date of Patent: Feb. 27, 2024

(54) TOILET FLUSH LEVER ASSEMBLY

(71) Applicant: Yi-Wen Tang, Taichung (TW)

(72) Inventors: Yi-Wen Tang, Taichung (TW); Jerry Cravens, Jr., Algonquin, IL (US)

(73) Assignee: Yi-Wen Tang, Taichung (TW)

( * ) Notice: Subject to any disclaimer, the term of this patent is extended or adjusted under 35 U.S.C. 154(b) by 724 days.

(21) Appl. No.: 17/105,177

(22) Filed: Nov. 25, 2020

(65) Prior Publication Data

US 2022/0098843 A1 Mar. 31, 2022

(30) Foreign Application Priority Data

Sep. 25, 2020 (TW) ..... 109212728

(51) Int. Cl.
*E03D 5/09* (2006.01)

(52) U.S. Cl.
CPC ..... *E03D 5/09* (2013.01)

(58) Field of Classification Search
CPC ..... E03D 5/09; E03D 5/092; F16C 11/106
USPC ..... 4/249, 324, 405, 411–414; 403/90
See application file for complete search history.

(56) References Cited

U.S. PATENT DOCUMENTS 511,479 A * 12/1893 Westbrook ..... B62K 21/16 D12/178
692,107 A * 1/1902 Bernz ..... E03D 1/34 4/411
892,105 A * 6/1908 White ..... F16L 3/202 248/62
1,317,903 A * 10/1919 Whimster ..... B60R 13/00 403/90
3,059,948 A * 10/1962 Thompson ..... F16C 11/106 84/421
4,620,813 A * 11/1986 Lacher ..... F16C 11/106 403/93
4,903,943 A * 2/1990 Hochstrasser ..... E03C 1/23 74/519
7,059,851 B2 * 6/2006 Kim ..... A61C 11/02 433/64
8,979,050 B2 * 3/2015 Yu ..... F16B 7/1454 403/90
9,637,900 B2 * 5/2017 Yang ..... E03D 1/14
10,233,624 B1 * 3/2019 Huang ..... E03D 5/092
2005/0273919 A1 * 12/2005 Berlovan ..... E03D 5/092 4/405
2007/0240256 A1 * 10/2007 Tau ..... E03D 5/092 4/405
2016/0174396 A1 * 6/2016 Wang ..... F16M 13/022 248/231.51

* cited by examiner

*Primary Examiner* — David P Angwin
*Assistant Examiner* — William R Klotz
(74) *Attorney, Agent, or Firm* — Muncy, Geissler, Olds & Lowe, P.C.

(57) ABSTRACT

A toilet flush lever assembly is provided, including: a handle member, including an operation member and a shaft connected with each other, the shaft being configured to be rotatably mounted to a water tank; a connection member, being movable and connected with the shaft, including a sleeve portion which is slit to include at least one first slit; a driving member, including a ball joint and a rod member connected with each other, the sleeve portion being disposed around the ball joint; an urging member, sleeved with and radially urging the sleeve portion to restrain the ball joint.

11 Claims, 10 Drawing Sheets

TOILET FLUSH LEVER ASSEMBLY

BACKGROUND OF THE INVENTION

Field of the Invention

The present invention relates to a toilet flush lever assembly.

Description of the Prior Art

The toilet is very basic equipment in day life. The toilet flushing mechanism is mounted with its handle to the water tank, wherein the handle is connected with a rod. A plug mechanism is connected with a rope which is connected to the rod. The handle is pressed to drive the rod and the rope so as to pull up the plug mechanism so that the water in the water tank flushes into the toilet.

However, there are various sizes and shapes of toilets and water tanks in the market, so rods of various sizes are needed for water tanks of various sizes, respectively, for effective driving the plug mechanism. As a result, it can increase the production cost.

The present invention is, therefore, arisen to obviate or at least mitigate the above-mentioned disadvantages.

SUMMARY OF THE INVENTION

The main object of the present invention is to provide a toilet flush lever assembly which is compatible for one of various water tanks.

To achieve the above and other objects, a toilet flush lever assembly is provided, including: a handle member, including an operation member and a shaft connected with each other, the shaft being configured to be rotatably mounted to a water tank; a connection member, being movable and connected with the shaft, including a sleeve portion which is slit to include at least one first slit; a driving member, including a ball joint and a rod member connected with each other, the sleeve portion being disposed around the ball joint; an urging member, sleeved with and radially urging the sleeve portion to restrain the ball joint.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
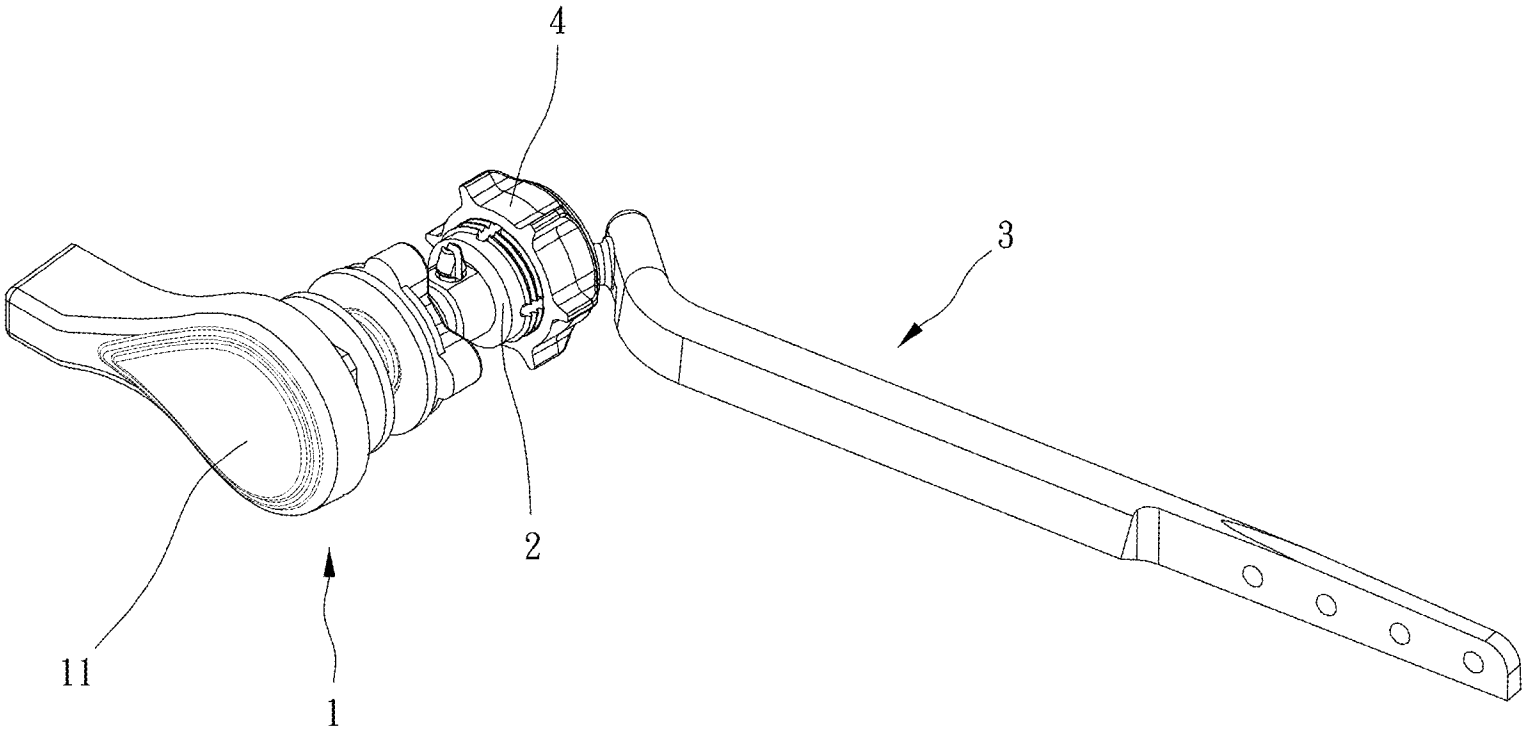
FIG. 1 is a stereogram of a preferable embodiment of the present invention.
Figure 2:
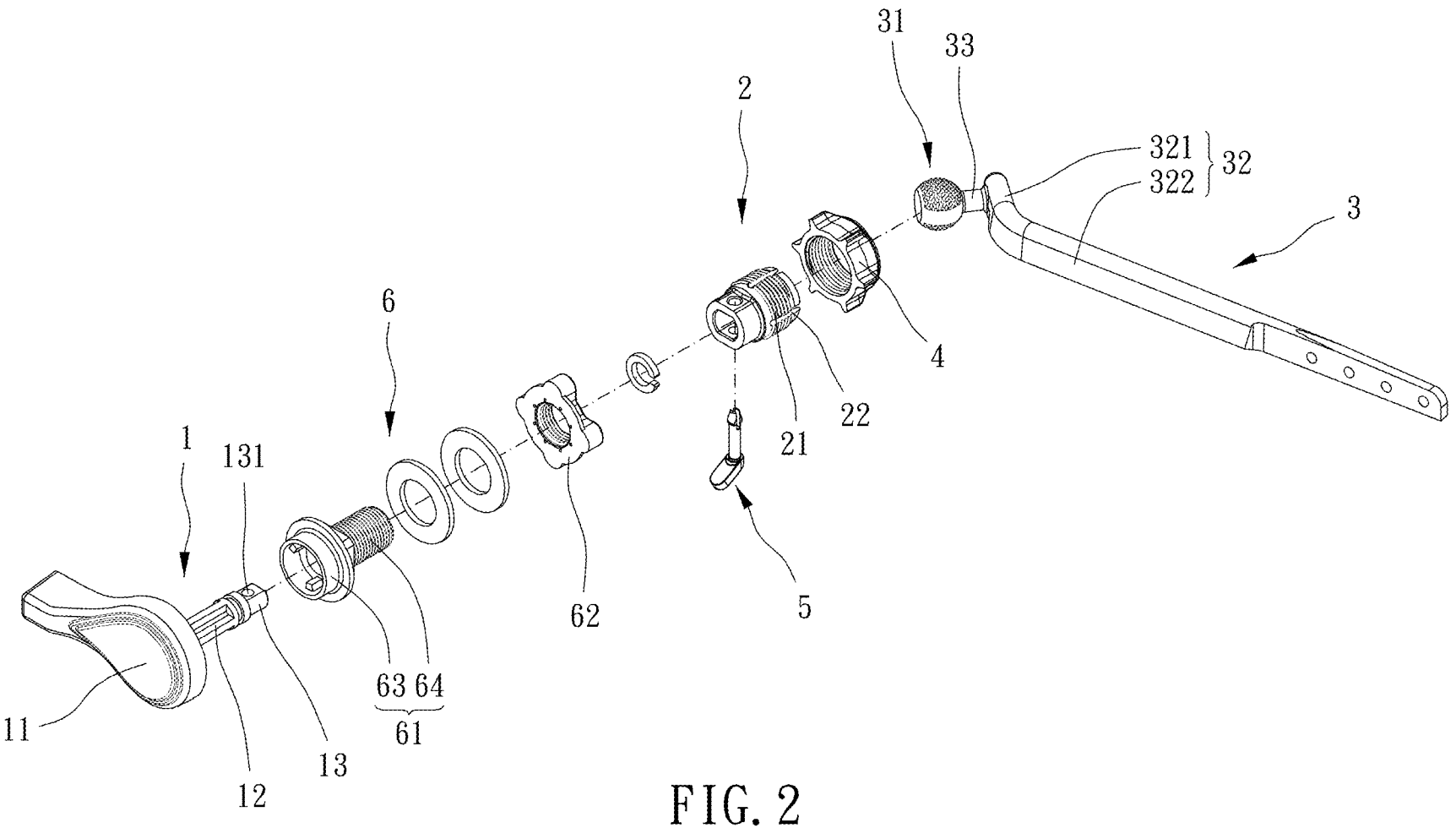
FIGS. 2 and 3 are breakdown drawings of a preferable embodiment of the present invention.
Figure 3:
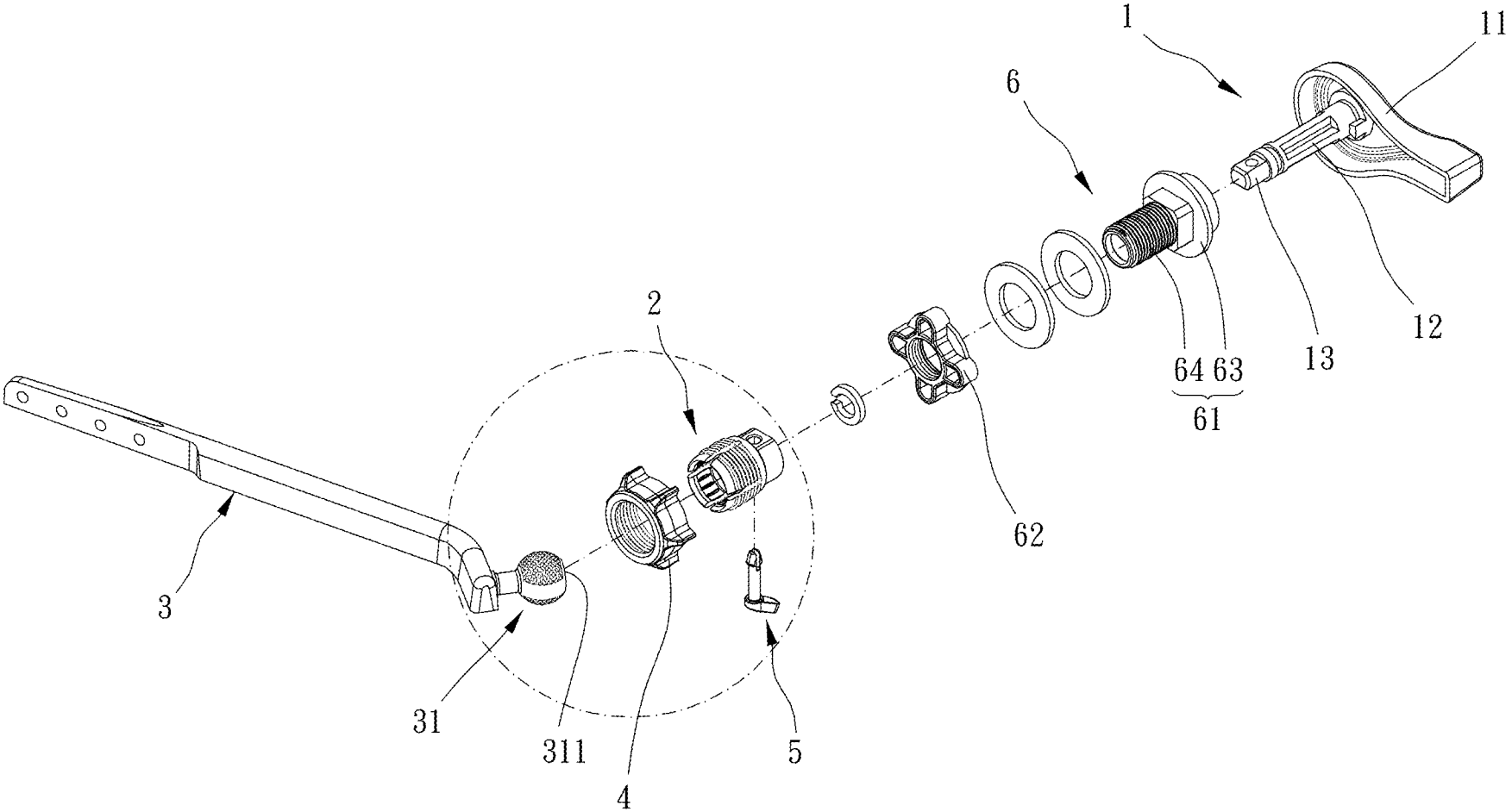
Figure 4:
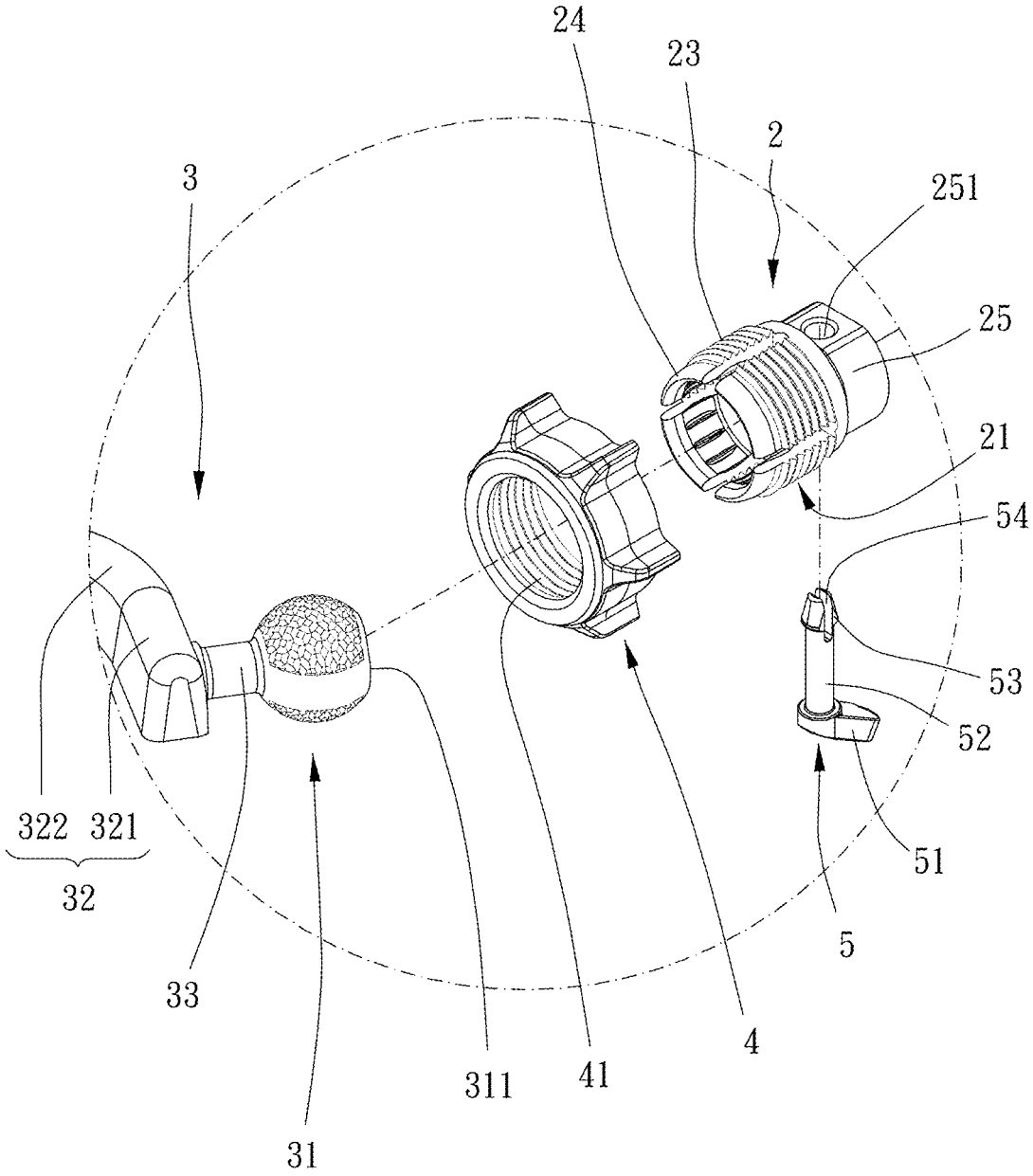
FIGS. 4 and 5 are partial enlarged breakdown drawings of a preferable embodiment of the present invention.
Figure 5:
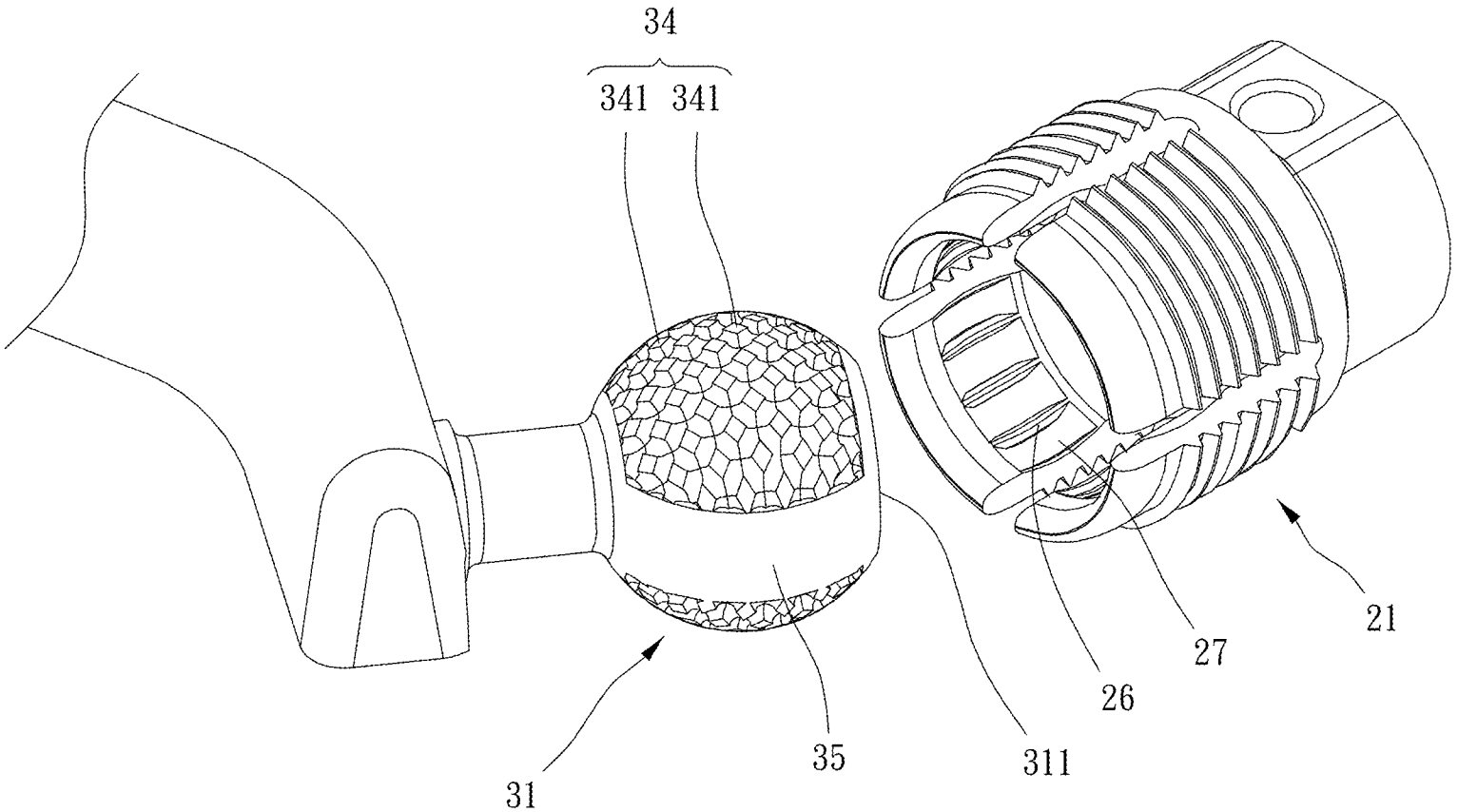
Figure 6:
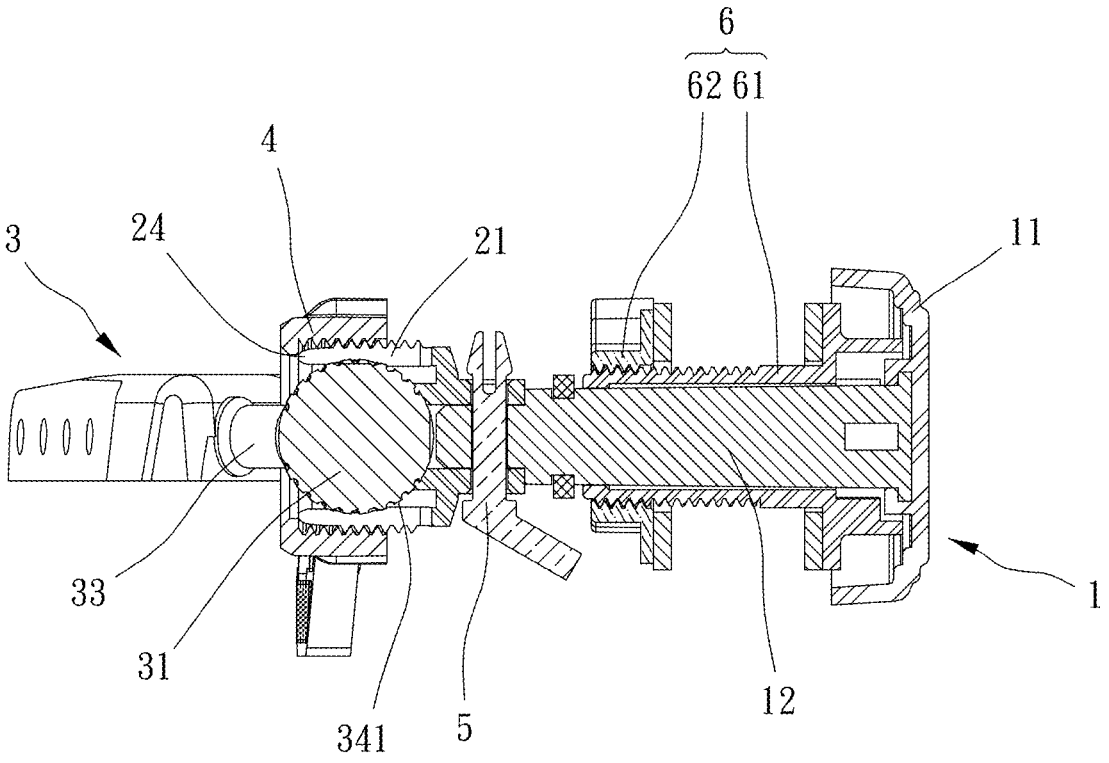
FIG. 6 is a cross-sectional view of a preferable embodiment of the present invention.
Figure 7:
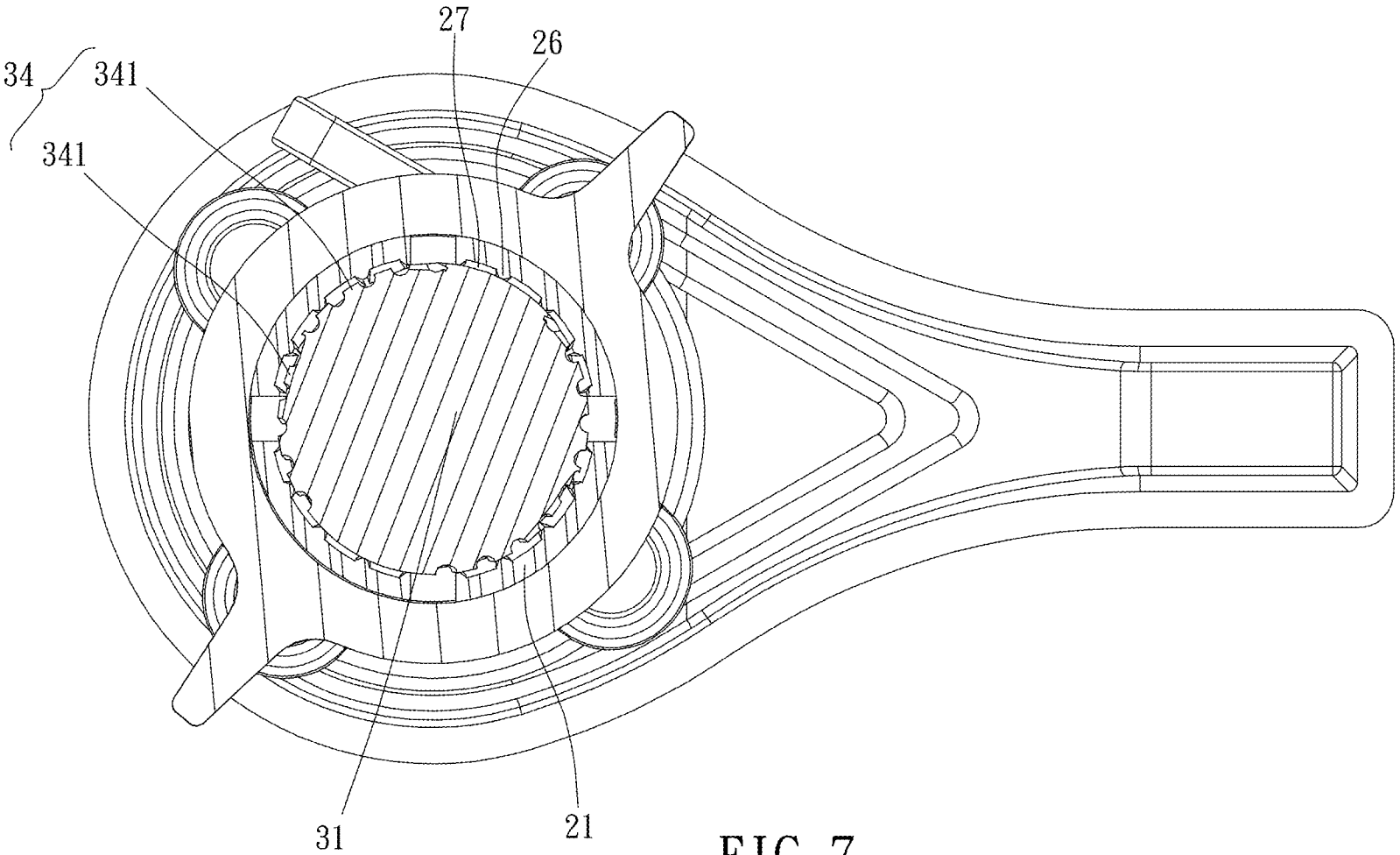
FIG. 7 is another cross-sectional view of a preferable embodiment of the present invention.
Figure 8:
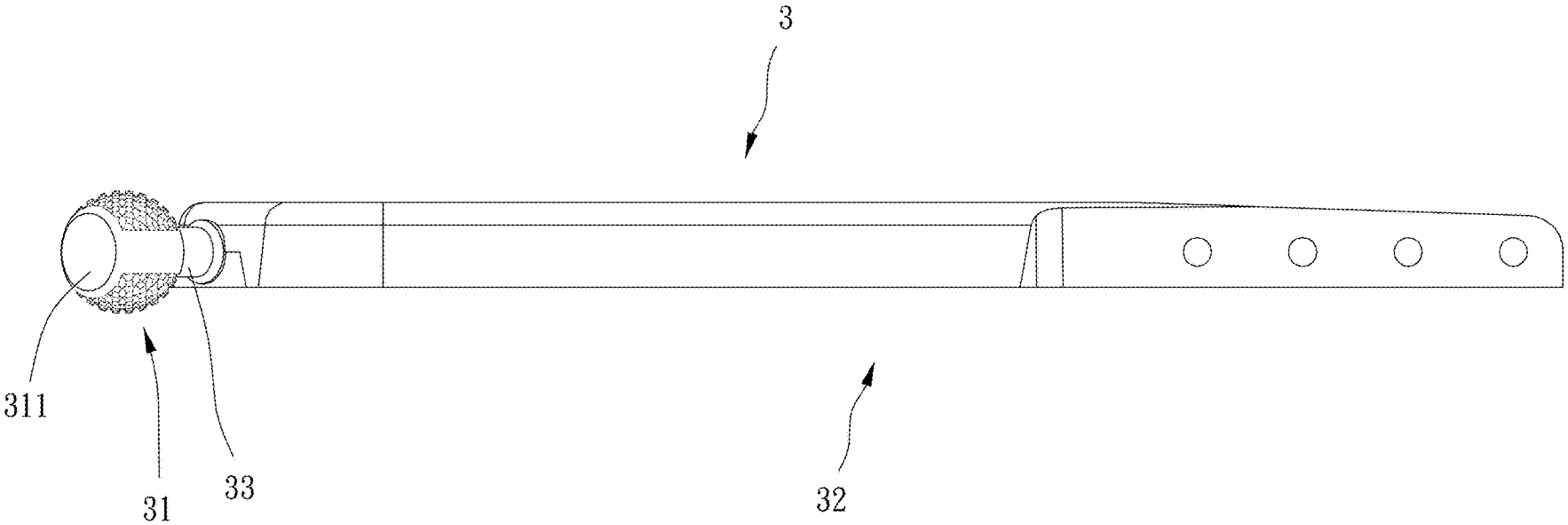
FIGS. 8 and 9 are side views of a driving member according to a preferable embodiment of the present invention.
Figure 9:
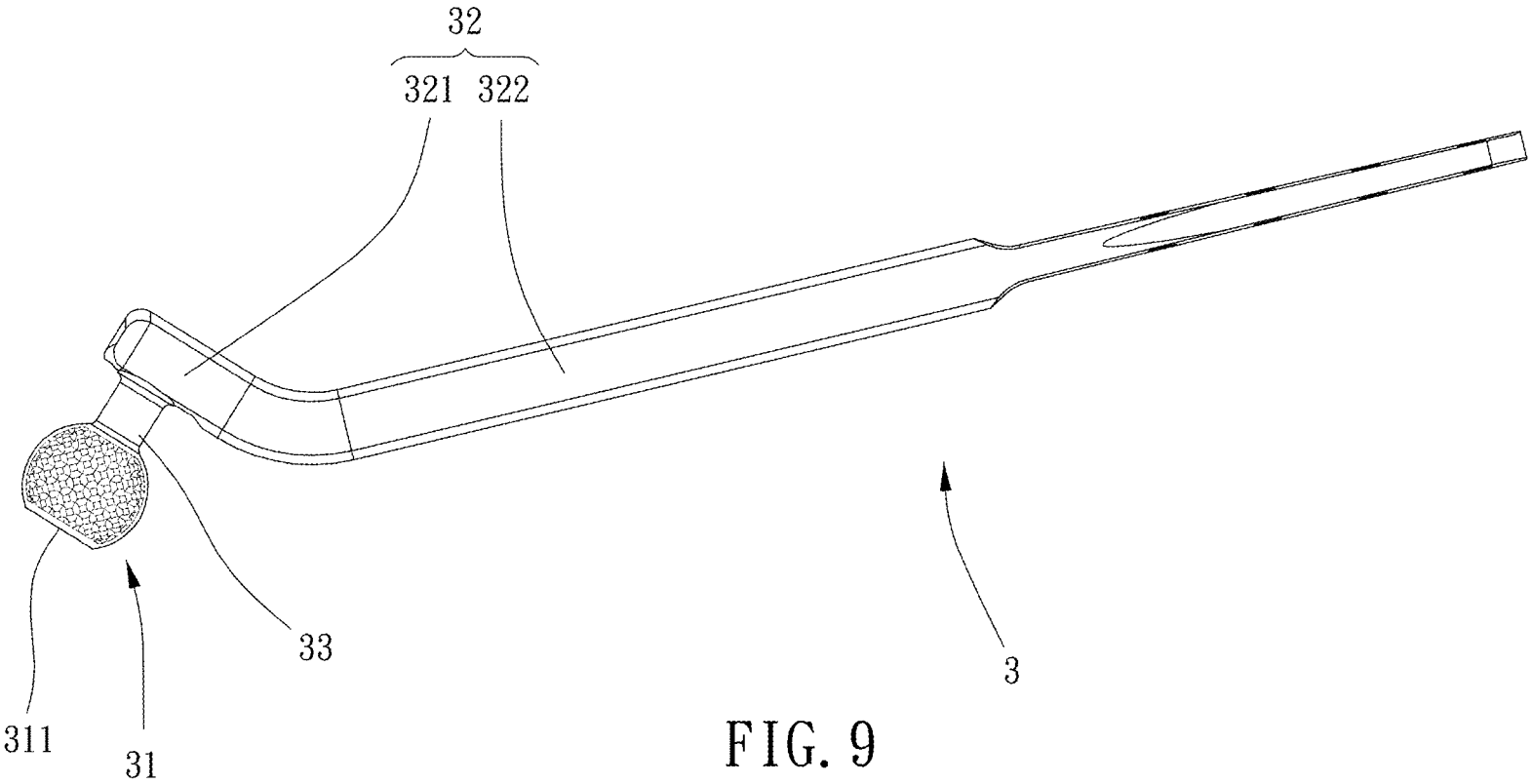
Figure 10:
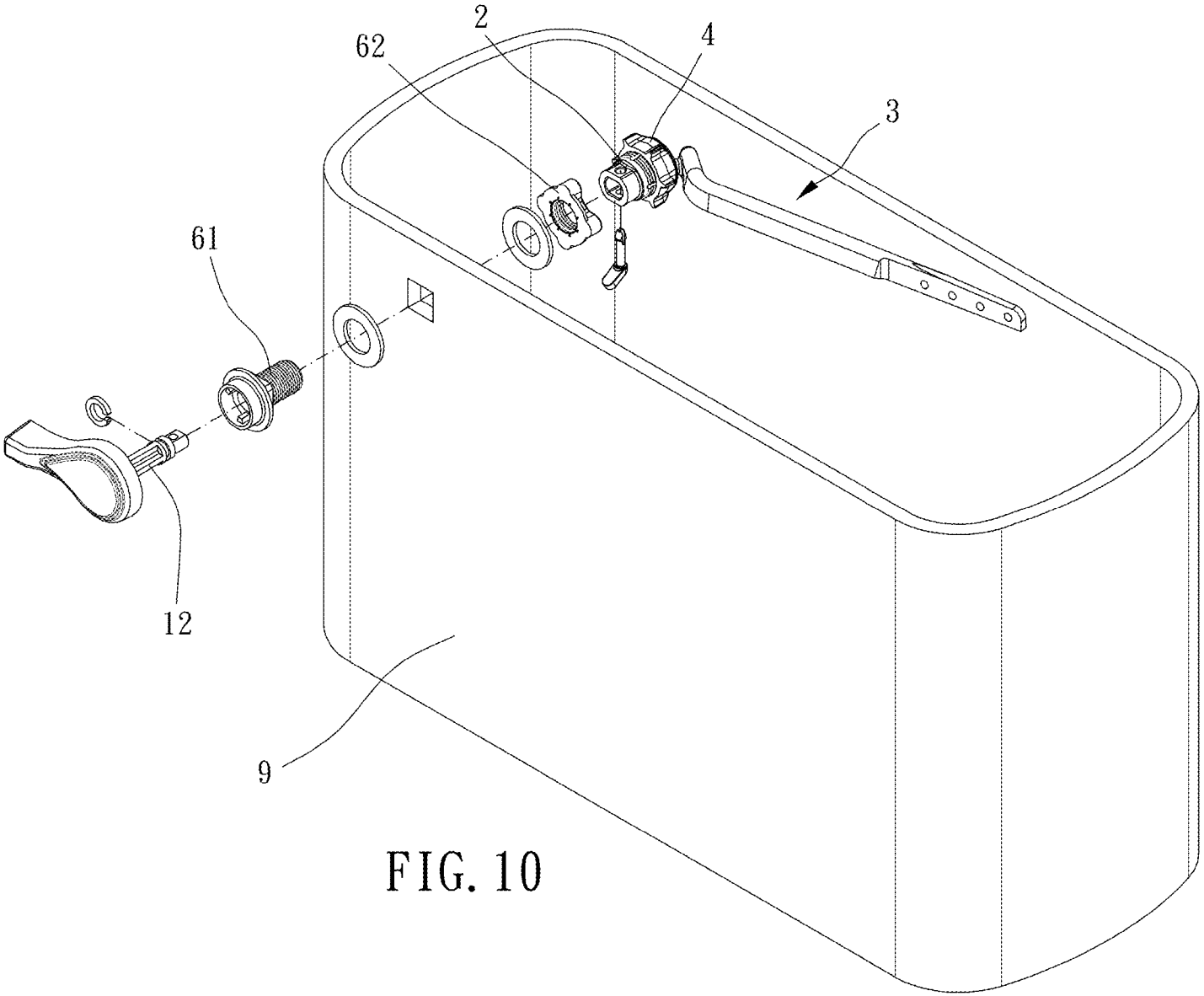
FIG. 10 is a drawing showing application according to a preferable embodiment of the present invention.

Please refer to FIGS. 1 to 10 for a preferable embodiment of the present invention. A toilet flush lever assembly 1 of the present invention includes a handle member 1, a connection member 2, a driving member 3 and an urging member 4.

The handle member 1 includes an operation member 11 and a shaft 12 connected with each other, and the shaft 12 is configured to be rotatably mounted to a water tank 9.

The connection member 2 is movable and connected with the shaft 12 and includes a sleeve portion 21 which is slit to include at least one first slit 22.

The driving member 3 includes a ball joint 31 and a rod member 32 connected with each other, and the sleeve portion 21 is disposed around the ball joint 31.

The urging member 4 is sleeved with and radially urging the sleeve portion 21 to restrain the ball joint 31.

During the mounting of the toilet flush lever assembly to the water tank 9, when the urging member 4 does not urge the sleeve portion 21, the ball joint 31 and the sleeve portion 21 are relatively rotatable so that the rod member 32 is swingable relative to the sleeve portion 21. The rod member 32 is then moved to a proper position, the urging member 4 urges the sleeve portion 21 so that the at least one first slit 22 contracts radially to restrain the ball joint 31, and the ball joint 31 is non-rotatable relative to the sleeve portion 21. Whereby, the toilet flush lever assembly is compatible for one of various water tanks.

Specifically, the sleeve portion 21 includes an outer threaded section 23, the urging member 4 is an annular member, the urging member 4 includes an inner threaded section 41 screwed with the outer threaded section 23, and the at least one first slit 22 extends to an end of the sleeve portion 21 remote from the shaft 12. Since the inner threaded section 41 is screwed with the outer threaded section 23, the sleeve portion 21 can effectively contract to stably restrain the ball joint 31.

Preferably, the end of the sleeve portion 21 remote from the shaft 12 is integrally formed with a tapered end 24, and the tapered end 24 is tapered toward a direction away from the shaft 12. Additionally, a circumferential surface of the tapered end 24 is non-threaded, and the at least one first slit 22 extends to the tapered end 24, so that it is easy to dispose the urging member 4 around the tapered end 24 and to be screwed with the outer threaded section 23.

Specifically, one of the connection member 2 and the shaft 12 includes a column 13, the other of the connection member 2 and the shaft 12 includes a sleeve portion 25, the column 13 includes a first through hole 131, the sleeve portion 25 includes a second through hole 251, and a pin 5 is inserted in or through the first through hole 131 and the second through hole 251. As a result, the connection member 2 and the shaft 12 may be separate parts and manufactured separately, and the connection member 2 and the shaft 12 can be assembled to cooperate. In this embodiment, the shaft 12 includes the column 13, and the connection member 2 includes the sleeve portion 25. In an alternative embodiment, the shaft may include the column, and the connection member may include the sleeve portion.

The pin 5 includes a grip portion 51, a body portion 52 and an enlarged portion 53 which are connected in sequence. Each of the grip portion 51 and the enlarged portion 53 has a diametric dimension larger than respective diametric dimensions of the first through hole 131 and the second through hole 251. The enlarged portion 53 is slit to include a second slit 54 by which the pin 5 can be disposed through the first through hole 131 and the second through hole 251 easily. The sleeve portion 25 and the column 13 are located between the enlarged portion 53 and the grip portion 51, and the pin 5 is free from disengaging from the sleeve portion 25 and the column 13. Whereby, the connection member 2 and the shaft 12 can be assembled quickly.

Specifically, the toilet flush lever assembly further includes a retaining assembly 6. The retaining assembly 6 includes a tubular member 61 and a nut 62. The tubular member 61 includes a head portion 63 and a mounting portion 64 connected with each other. The mounting portion 64 is unrotatably disposed through the water tank 9, and the nut 62 is screwed with the mounting portion 64, and the head portion 63 and the tubular member 61 are configured to be abutted against two sides of the water tank 9. The shaft 12 is rotatably disposed through the tubular member 61, and the retaining assembly 6 allows rotation of the shaft 12 relative to the water tank 9.

The driving member 3 further includes a connecting section 33, the connecting section 33 is connected between the rod member 32 and the ball joint 31, and the connecting section 33 and the rod member 32 are angularly connected with each other.

Specifically, a diametric dimension of the connecting section 33 is smaller than a diametric dimension of the ball joint 31, which can avoid interference of the connecting section 33 with the sleeve portion 21 during swinging of the connecting section 33. An end of the ball joint 31 remote from the connecting section 33 includes a plane 311, which improves the mounting of the ball joint 31 into the sleeve portion 21. The rod member 32 includes a bent section 321 and a straight section 322, and the bent section 321 is connected between the straight section 322 and the connecting section 33. The bent section 321 and the connecting section 33 are angularly connected with each other and define an angle between 80 degrees and 100 degrees, and the bent section 321 and the straight section 322 are angularly connected with each other and define an angle between 110 degrees and 160 degrees. In this embodiment, the bent section 321 and the connecting section 33 are angularly connected with each other and define an angle of 90 degrees, and the bent section 321 and the straight section 322 are angularly connected with each other and define an angle of 135 degrees. An extent of the straight section 322 is more than 5 times an extent of the bent section 321, for cooperating with the water tank 9.

Preferably, an outer surface of the ball joint 31 includes a rugged structure 34 and a smooth section 35, and the rugged structure 34 includes a plurality of bumpy portions 341. An inner circumferential wall of the sleeve portion 21 includes a plurality of ribs 26 and a plurality of recesses 27, and the plurality of ribs 26 and the plurality of recesses 27 extend axially and are alternatively arranged circumferentially. When the sleeve portion 21 radially urges the ball joint 31, part of the plurality of bumpy portion 341 are located within the recesses 27 and part of the plurality of bumpy portion 341 are abuttable against the plurality of ribs 26, which can effectively avoid rotation the ball joint 31 relative to the sleeve portion 21.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A toilet flush lever assembly, including:

a handle member, including an operation member and a shaft connected with each other, the shaft being configured to be rotatably mounted to a water tank;

a connection member, being movable and connected with the shaft, including a sleeve portion which is slit to include at least one first slit;

a driving member, including a ball joint and a rod member connected with each other, the sleeve portion being disposed around the ball joint;

an urging member, sleeved with and radially urging the sleeve portion to restrain the ball joint;

wherein one of the connection member and the shaft includes a column, the other of the connection member and the shaft includes another sleeve portion, the column includes a first through hole, the another sleeve portion includes a second through hole, and a pin is inserted in the first through hole and the second through hole;

wherein the pin includes a grip portion, a body portion and an enlarged portion which are connected in sequence, each of the grip portion and the enlarged portion has a diametric dimension larger than respective diametric dimensions of the first through hole and the second through hole, and the enlarged portion is slit to include a second slit.

2. The toilet flush lever assembly of claim 1, wherein the sleeve portion includes an outer threaded section, the urging member is an annular member, the urging member includes an inner threaded section screwed with the outer threaded section, and the at least one first slit extends to an end of the sleeve portion remote from the shaft.

3. The toilet flush lever assembly of claim 2, wherein the end of the sleeve portion remote from the shaft is integrally formed with a tapered end, and the tapered end is tapered toward a direction away from the shaft.

4. The toilet flush lever assembly of claim 3, wherein a circumferential surface of the tapered end is non-threaded, and the at least one first slit extends to the tapered end.

5. The toilet flush lever assembly of claim 1, further including a retaining assembly, the retaining assembly including a tubular member and a nut, the tubular member including a head portion and a mounting portion connected with each other, the mounting portion being unrotatably disposed through the water tank, the nut being screwed with the mounting portion, the head portion and the tubular member being configured to be abutted against two sides of the water tank respectively, the shaft being rotatably disposed through the tubular member.

6. The toilet flush lever assembly of claim 1, wherein the driving member further includes a connecting section, the connecting section is connected between the rod member and the ball joint, and the connecting section and the rod member are angularly connected with each other.

7. The toilet flush lever assembly of claim 6, wherein a diametric dimension of the connecting section is smaller than a diametric dimension of the ball joint, an end of the ball joint remote from the connecting section includes a plane, the rod member includes a bent section and a straight section, and the bent section is connected between the straight section and the connecting section.

8. The toilet flush lever assembly of claim 7, wherein the bent section and the connecting section are angularly connected with each other and define an angle between 80 degrees and 100 degrees, and the bent section and the straight section are angularly connected with each other and define an angle between 110 degrees and 160 degrees.

9. The toilet flush lever assembly of claim 4, wherein the toilet flush lever assembly further includes a retaining assembly, the retaining assembly includes a tubular member and a nut, the tubular member includes a head portion and a mounting portion connected with each other, the mounting portion is unrotatably disposed through the water tank, the nut is screwed with the mounting portion, the head portion and the tubular member are configured to be abutted against two sides of the water tank respectively, the shaft is rotatably disposed through the tubular member; the driving member further includes a connecting section, the connecting section is connected between the rod member and the ball joint, and the connecting section and the rod member are angularly connected with each other; a diametric dimension of the connecting section is smaller than a diametric dimension of the ball joint, an end of the ball joint remote from the connecting section includes a plane, the rod member includes a bent section and a straight section, the bent section is connected between the straight section and the connecting section, the bent section and the connecting section are angularly connected with each other and define an angle of 90 degrees, and the bent section and the straight section are angularly connected with each other and define an angle of 135 degrees; an extent of the straight section is more than 5 times an extent of the bent section.

10. The toilet flush lever assembly of claim 4, wherein an outer surface of the ball joint includes a rugged structure and a smooth section, and the rugged structure includes a plurality of bumpy portions.

11. The toilet flush lever assembly of claim 10, wherein an inner circumferential wall of the sleeve portion includes a plurality of ribs and a plurality of recesses, and the plurality of ribs and the plurality of recesses extend axially and are alternatively arranged circumferentially.

* * * * *